United States Patent [19]

Osawa

[11] Patent Number: 4,856,245

[45] Date of Patent: Aug. 15, 1989

[54] SUPPORT PLATE FOR TILES

[76] Inventor: Yoshinori Osawa, 178, Oaza Sagami, Koka-cho, Koka-gun, Shiga, Japan

[21] Appl. No.: 680,643

[22] Filed: Dec. 11, 1984

[30] Foreign Application Priority Data

Dec. 19, 1983 [JP] Japan ..... 58-196976

[51] Int. Cl.[4] ..... E04F 13/12; E04F 13/08

[52] U.S. Cl. ..... 52/386; 52/387; 52/391; 52/509; 52/510

[58] Field of Search ..... 52/387, 384, 385, 386, 52/478, 487, 509, 510, 550

[56] References Cited

U.S. PATENT DOCUMENTS

| | | | |
|---|---|---|---|
| 874,909 | 12/1907 | Fischer | 52/386 |
| 1,604,968 | 11/1926 | Burris | 52/510 |
| 1,861,359 | 5/1932 | Pyron | 52/387 |
| 1,982,560 | 11/1934 | Williams | 52/387 |
| 2,016,918 | 10/1935 | Born | 52/385 |
| 2,043,706 | 6/1936 | Myers | 52/387 |
| 2,053,412 | 9/1936 | Berson | 52/387 |
| 2,056,732 | 10/1936 | Mekler | 52/386 |
| 2,066,268 | 12/1936 | Hohner | 52/385 |
| 3,005,293 | 10/1961 | Hunter | 52/487 |
| 3,292,333 | 12/1966 | Sandmeyer et al. | 52/509 |
| 3,387,422 | 6/1968 | Wanzer | 52/387 |
| 4,262,464 | 4/1981 | Ludowici | 52/510 |

FOREIGN PATENT DOCUMENTS

| | | | |
|---|---|---|---|
| 90530 | 12/1922 | Austria | 52/550 |
| 2013857 | 8/1978 | Fed. Rep. of Germany | 52/510 |
| 37007 | 3/1923 | Norway | 52/550 |
| 321068 | 2/1970 | Sweden | 52/386 |
| 29362 | of 1884 | United Kingdom | 52/550 |
| 905512 | 9/1962 | United Kingdom | 52/510 |
| 1275746 | 5/1972 | United Kingdom | 52/478 |
| 2108173 | 5/1985 | United Kingdom | 52/384 |

*Primary Examiner*—Alfred C. Perham

*Attorney, Agent, or Firm*—Wenderoth, Lind & Ponack

[57] ABSTRACT

A support plate for tiles comprises a rectangular metal plate formed with a plurality of tile support pieces projecting out of the metal plate. The end portions of tile support pieces are bent to form flanges which are adapted to fit into a groove or grooves provided in a tile.

2 Claims, 4 Drawing Sheets

SUPPORT PLATE FOR TILES

BACKGROUND OF THE INVENTION

1. Field of the Invention

The present invention relates to a support plate for tiles to be set on the surface of a building.

2. Description of the Prior Art

So far, tiles have been set on the surface of a building by applying mortar on the surface or on the tile back and pressing them thereagainst. Consequently, the work of tiling with uniform spaces between the tiles and making their surfaces even has required a great deal of skill.

The conventional tiling construction has another disadvantage in that the lower rows of tiles will come off if the load of the tiles laid thereupon exceeds the limit which can be withstood by them. Because of this possibility, the number of rows of tiles which can be set in one day had to be restricted.

The conventional tiling construction has still another disadvantage in that it requires a large quantity of mortar and it requires that liquid cement has to be sprayed upon the surface of the mortar for the acceleration of the hardening of the mortar with a concomitant result of soiling the tiles and the surroundings with the cement.

SUMMARY OF THE INVENTION

It is an object of the present invention to provide a support plate for which obviates the necessity of a great, deal of skill for leaving uniform spaces between for tiles and making their surfaces even.

It is another object of the present invention to provide a support plate which permits tile-setting without restrictions on the number of rows of tiles which can be set in one day and yet precludes the possibility of the peeling-off of the lower tiles.

In accordance with the present invention, there is provided a support plate comprising a rectangular metal plate having a plurality of tile support pieces, said support pieces each having a web portion perpendicular to said metal plate and a flange portion parallel with said metal plate.

With the above-described objects in view and as will become apparent from the following detailed description, the present invention will be more clearly understood in connection with the accompanying drawings.

DETAILED DESCRIPTION OF THE INVENTION

Figure 1:
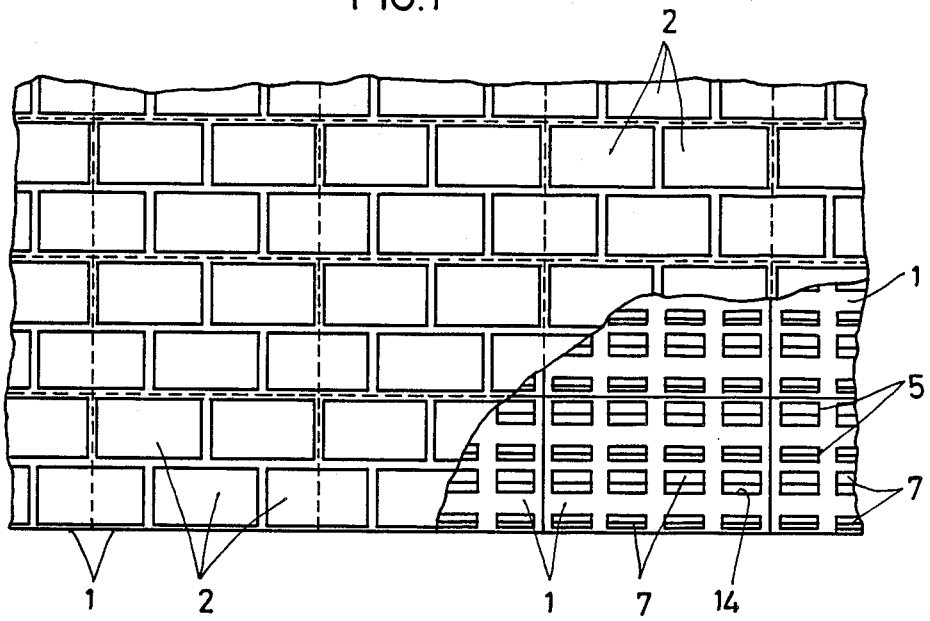
FIG. 1 is a partially cutaway front view of part of a wall tiled by use of the support plates according to the present invention.

Referring now to FIG. 1, a plurality of rectangular metal plates 1 are nailed or otherwise mounted on the surface of a building. L-shaped tile support pieces 5 project out of the surface of each metal plate 1 in such positions as to conform to the positions of tiles 2 to be arranged on the surface of the metal plate 1.

Figure 2:
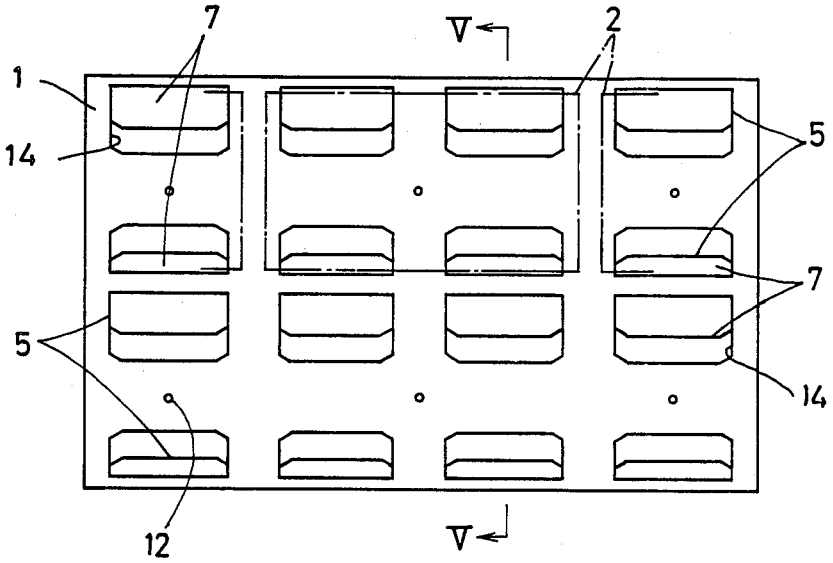
FIGS. 2 to 4 are front views of the first, second and third embodiment.
Figure 5:
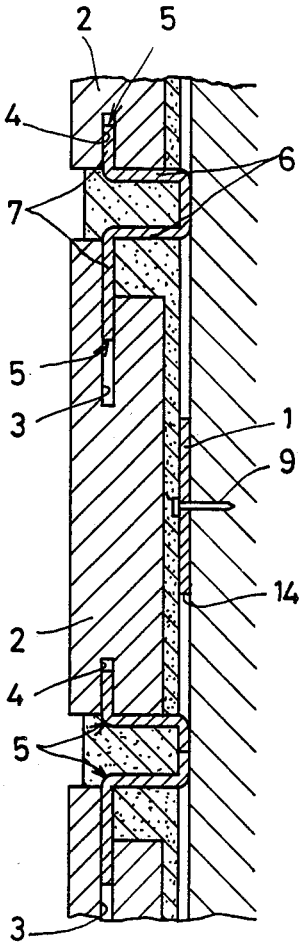
FIG. 5 is a sectional view taken along line V—V of FIG. 2.

In the first embodiment shown in FIGS. 2 and 5, the tile support pieces 5 project out of the surface of each metal plate 1 at intervals. Their end portions are bent in opposite directions, leaving webs 6 perpendicular to the metal plate 1, flanges 7 being bent so as to run parallel with the metal plate 1. Each tile 2 designed for this embodiment is supported by two pairs of vertically spaced support pieces 5, the flanges 7 of which are vertically disposed In each pair of vertically spaced support pieces 5, the vertical length of the upper (i.e. downward) flange 7 is longer than that of the lower (i.e. upward) flange 7.

To mount the tile 2 on the metal plate 1 of this embodiment, the upper (downward) flanges 7 are fitted into a groove 3 provided in the upper edge of the tile 2. Then the lower (upward) flanges 7 are allowed to fit into a groove 4 provided in the lower edge of the tile 2. In order that this way of mounting the tile 2 on the metal plate 1 of this embodiment may be possible, the groove 3 should be deeper than the groove 4.

Figure 3:
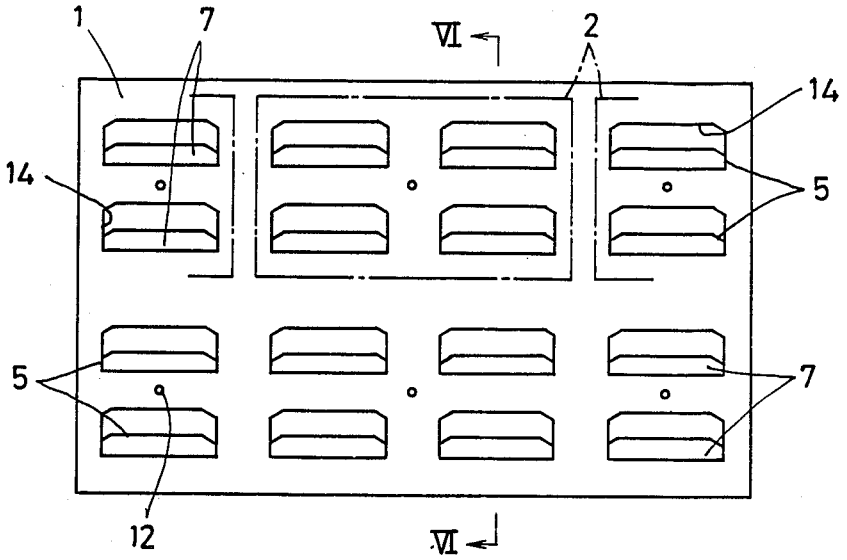
Figure 6:
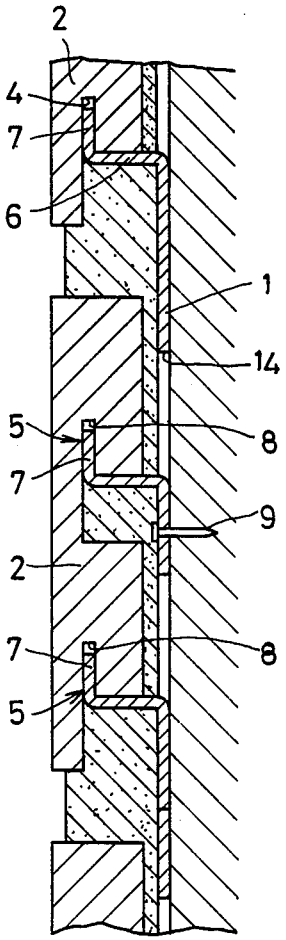
FIG. 6 is a sectional view taken along line VI—VI of FIG. 3.

In the second embodiment shown in FIGS. 3 and 6, all the flanges 7 are bent in the same (i.e. upward) direction. Each tile 2 designed for this embodiment is provided with two grooves 8 running parallel with the metal plate 1. One of the grooves 8 is provided in the back middle of the tile 2, while the other is provided in the lower edge of the tile 2.

To mount the tile 2 on the metal plate 1 of this embodiment, the tile 2 is lowered until and so that the upper edges of the flanges 7 will fit into the L-shaped grooves 8.

Figure 4:
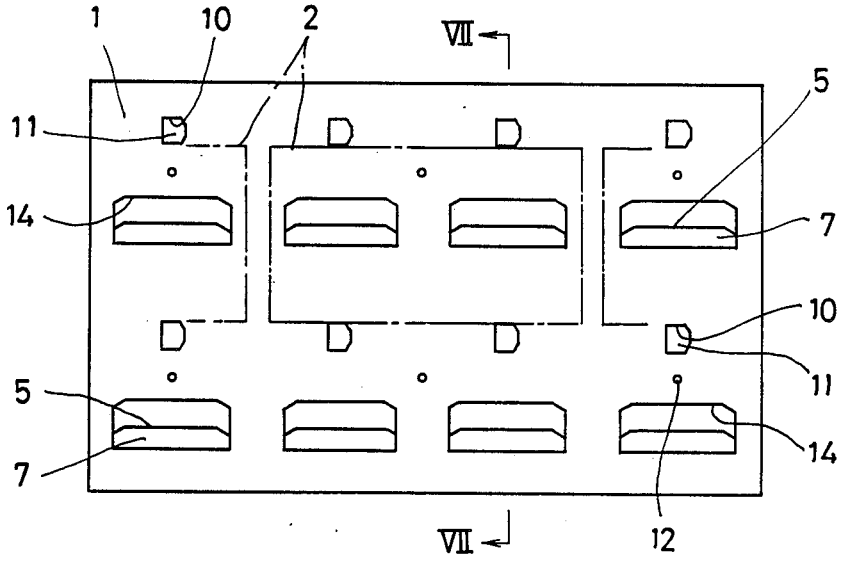
Figure 7:
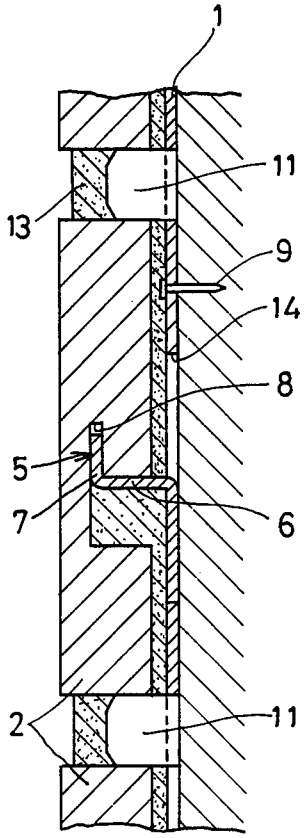
FIG. 7 is a sectional view taken along line VII—VII of FIG. 4.

In the third embodiment shown in FIGS. 4 and 7, all the flanges 7 are bent in the same (i.e. upward) direction. Each tile 2 designed for this embodiment is provided with a single L-shaped groove 8 in the back thereof to allow the flanges 7 to fit therein, and can be mounted on the metal plate 1 of this embodiment in the same manner as in the second embodiment. Each time a tile 2 has been mounted on the metal plate 1, tongues 11 formed by C-shaped cuts 10 (FIG. 4) in the metal plate 1 are pryed by means of a screwdriver or the like so as to bring the lower edges of the tongues 11 into contact with the upper edge of the tile 2 and thereby secure the tile 2 in position.

Figure 8:
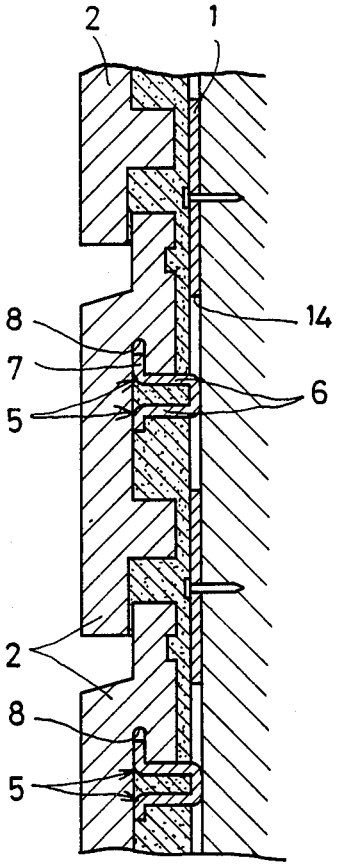
FIGS. 8 and 9 are sectional views of other embodiments.
Figure 9:
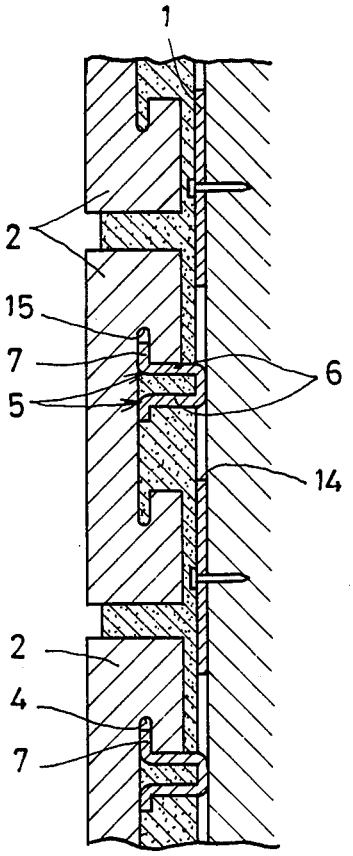

In the fourth embodiment shown in FIGS. 8 and 9, the tile support pieces 5 are substantially the same as those of the first embodiment. Each tile 2 designed for this embodiment is provided with an L-shaped groove 8 (FIG. 8) or a T-shaped groove 15 (FIG. 9) in the back thereof.

To mount the tile 2 on the metal plate 1 of this embodiment, the groove 8 or 15 is filled with a mass of mortar and then the tile 2 is pressed against the metal plate 1 and forced down so as to allow the upward flange 7 to fit into the vertical portion of the L- or T-shaped groove 8 or 15.

Although only two rows of tiles 2 are mounted on each metal plate 1 in the preferred embodiments shown in the drawings, the metal plate 1 may be of larger size so as to be capable of bearing more than two rows of tiles 2.

In the embodiments shown in the drawings, the metal plates 1 are secured to the surface of a building by means of nails 9 (FIGS. 5, 6 and 7) driven through holes 12 (FIGS. 2, 3 and 4). However, the metal plates 1 may be secured by spot welding.

If a space is left between the back of the metal plate 1 and the surface of a building, such a space may be stuffed with mortar of foamed plastics poured through the openings 14 formed by striking the tile support pieces 5.

When the necessary number of tiles 2 have been mounted on the metal plates 1, the space left between adjacent tiles 2 is filled with mortar 13 (FIG. 7).

The present invention obviates the necessity of stretching a string for aligning each row of tiles 2, and gives a good appearance to the tiled wall with a uniform space left between the tiles 2.

The present invention has further advantages in that it permits tile-setting without restrictions on the number of rows of tiles 2, that the metal plates 1 can be manufactured at low cost because the tile support pieces 5 can be formed simply by press work, and that the tiles 2 can be protected from cracking or peeling-off, even if the tiled wall is jolted.

What are claimed are:

1. An arrangement for tiling a surface of a building, comprising:

a plurality of rectangular metal plates mounted on the surface of the building;

a plurality of tile support pieces being aligned in rows and projecting out of an external surface of each of the plurality of rectangular metal plates;

each of said plurality of tile support pieces having a web portion perpendicular to the external surface of each of the plurality of rectangular metal pieces and also having a flange portion parallel to but spaced from the external surface of each of the plurality of rectangular metal plates;

wherein flange portions of said plurality of tile support pieces extend from said web portions of said plurality of tile support pieces in an identical vertically upward direction;

a plurality of tiles being mounted on the plurality of rectangular metal plates and each having a stepped lower edges;

an L-shaped groove means, provided in a middle back side of each of said plurality of tiles, for allowing the flange portions of one row of said plurality of tile support pieces to fit therein without being seen from a front side of each of said plurality of tiles; and a second groove means, provided in the stepped lower edge of each of said plurality of tiles, for allowing the flange portions of alternate rows of said plurality of tile support pieces to fit therein so that each of the plurality of tiles is vertically supported along its stepped lower edge by the web portions of said plurality of tile support pieces without being seen from a front side of each of the plurality of tiles.

2. An arrangement for tiling a surface of a building, comprising:

a plurality of rectangular metal plates mounted on the surface of the building;

a plurality of tile support pieces projecting out of an external surface of each of the plurality of rectangular metal plates;

each of said plurality of tile support pieces having a U-shaped web portion perpendicular to the external surface of each of the plurality of rectangular metal plates and also having a flange portion parallel to but spaced from the external surface of each of the plurality of rectangular metal plates;

wherein flange portions of said plurality of tile support pieces extend from the U-shaped web portions of said plurality of tile support pieces in opposite vertical directions;

a plurality of tiles being mounted on the plurality of rectangular metal plates and each having stepped upper and lower edges;

a single L-shaped groove means, provided in a middle back side of each of said plurality of tiles, for allowing the flange portions of each of said tile support pieces to fit therein without being seen from a front side of each of said plurality of tiles; and edge means, provided along the upper edge of each of said plurality of tiles, for covering a space left between the upper edge of one of said plurality of tiles and the lower edge of an adjacent one of said plurality of tiles arranged above said one of said plurality of tiles.

* * * * *